US005785038A

United States Patent [19]

Mattern

[11] Patent Number: 5,785,038

[45] Date of Patent: Jul. 28, 1998

[54] CANNON FOR DISARMING AN EXPLOSIVE DEVICE

[75] Inventor: Charles C. Mattern, Clermonte, Fla.

[73] Assignee: Earth Resources Corporation, Ocoee, Fla.

[21] Appl. No.: 645,704

[22] Filed: May 14, 1996

Related U.S. Application Data

[60] Division of Ser. No. 520,792, Aug. 30, 1995, which is a continuation-in-part of Ser. No. 119,717, Sep. 10, 1993, Pat. No. 5,460,154.

[51] Int. Cl.[6] ..... F41B 9/00

[52] U.S. Cl. ..... 124/56; 124/71

[58] Field of Search ..... 124/56, 61, 63–67, 124/70, 71; 86/50

[56] References Cited

U.S. PATENT DOCUMENTS

| | | | |
|---|---|---|---|
| Re. 33,799 | 1/1992 | Gold et al. | 141/51 |
| 1,167,178 | 1/1916 | Hill | 124/56 |
| 1,806,270 | 5/1931 | Thompson | 15/3.5 |
| 3,091,052 | 5/1963 | Ryan | 124/56 X |
| 3,422,808 | 1/1969 | Stein et al. | 124/61 |
| 3,428,037 | 2/1969 | Capriolo et al. | 124/61 |
| 4,046,055 | 9/1977 | McDanolds et al. | 86/50 |
| 4,169,403 | 10/1979 | Hanson | 86/50 |
| 4,690,180 | 9/1987 | Gold | 141/51 |
| 4,944,333 | 7/1990 | Gold et al. | 141/51 |
| 5,134,921 | 8/1992 | Breed et al. | 86/50 |
| 5,186,219 | 2/1993 | Gold et al. | 141/51 |
| 5,210,368 | 5/1993 | Heller et al. | 86/50 |
| 5,230,324 | 7/1993 | Van Horssen et al. | 124/61 |
| 5,339,876 | 8/1994 | Mattern | 141/51 |
| 5,460,154 | 10/1995 | Mattern et al. | 124/56 |

FOREIGN PATENT DOCUMENTS 2120761 12/1983 United Kingdom .

OTHER PUBLICATIONS

"Specifications for Chemical Control Site Gas Cylinder Removal," US Army Corps of Engineers, Jun. 1987.

"Supplement C to Project Eagle –Phase II Demilitarization and Disposal Of The M34 Cluster At Rocky Mountain Arsenal Final Plan (Feb. 1973)".Jul. 1975.

"Alternative Technologies for the Destruction of Chemical Agents and Munitions," National Academy Press, Washington, D.C. 1993.

Browne, "Big Gun Makes Hydrogen Into a Metal," *New York Times*, Mar. 26, 1996, pp. C1 and C7.

Kerr, "Shock Test Squeezes Core Temperature," *Science*, vol. 267, Mar. 17, 1995, pp. 1597–1598.

*Primary Examiner*—John A. Ricci

*Attorney, Agent, or Firm*—Hunton & Williams

[57] ABSTRACT

A projectile substance is pneumatically propelled. The projection substance is inserted onto a longitudinal bore of a barrel and a rupture disk is attached to a first end of the barrel. Next, the first end of the barrel is coupled to a first end of a pneumatic reservoir having a chamber therein. The rupture disk, as attached, acts to form a seal between the longitudinal bore and the chamber. Then, a gas is introduced into the chamber until a sufficient pressure is attained within the chamber to rupture the disk. When the disk ruptures, the gas in the chamber rushes into the longitudinal bore with sufficient force to propel the projectile substance out of the barrel. One or more pistons may be slidably disposed within the chamber to form more than one chamber portion. An average pressure for propelling the projectile substance may be increased by various methods of forcing the piston(s) toward the projectile substance as it is being driven out of the barrel. Additionally, if more than one piston, for example two pistons, are provided, the pistons may have different end surface areas to create a pressure multiplication effect. Accordingly, the pressure available for propelling the projectile substance can be greater than the source pressure. Also, rupture pressure in the chamber can be achieved by heating a liquid in the chamber.

17 Claims, 12 Drawing Sheets

CANNON FOR DISARMING AN EXPLOSIVE DEVICE

This application is a division of application Ser. No. 08/520,792, filed on Aug. 30, 1995, entitled CANNON FOR DISARMING AN EXPLOSIVE DEVICE, which is a continuation-in-part of application Ser. No. 08/119,717, filed on Sep. 10, 1993, entitled METHOD FOR PNEUMATICALLY PROPELLING A PROJECTILE SUBSTANCE, now U.S. Pat. No. 5,460,154, issued on Oct. 24, 1995.

BACKGROUND OF THE INVENTION

1. Field of the Invention

The invention relates generally to methods of propelling a projectile substance and, more specifically, to methods of propelling a projectile substance by the release of pressure from a chamber.

2. Description of the Related Art

Procedures for disarming an explosive device should minimize the potential risk of accidentally detonating the explosive material contained within the device. The explosive device often includes associated electronic circuitry for detonating the explosive. A proven disarming technique is to deactivate or destroy the circuitry before it can detonate the explosive.

Because such circuitry is typically sensitive to tampering, the disarming procedure should deactivate the circuitry within a short time after any contact with, or movement of, the device has been initiated.

One procedure for disarming an electronically controlled explosive device is to fire a projectile into the circuitry of the device. The projectile typically pierces the housing of the device and deactivates the circuitry before the circuitry can detonate the explosive material.

Typically, a gun assembly is used to fire the projectile at the device enclosure. For example, a charge of smokeless gunpowder, ignited by an electric match, may impart the required momentum to the projectile.

A problem associated with using gunpowder to propel the projectile is the creation of a flame front, which exhausts from the end of a projectile barrier within the barrel of the gun assembly. This flame front frequently causes the explosive device to ignite or detonate.

Other problems exist with known disarming devices. For example, the type of projectile which may be used with existing systems is limited. Also, the speed of the projectile is often difficult to control or vary to meet specific requirements. Another problem with conventional procedures is that the electric match can prematurely fire the gun assembly. One cause of premature firing is stray electromagnetic energy, e.g. radio waves, which may provide a premature ignition signal to the match. Premature firing, particularly before the gun is properly aimed or mounted, can damage the gun assembly as well as other objects in the vicinity of the gun assembly. It will be recognized that other problems result from the use of existing methods for propelling projectile substances.

SUMMARY OF THE INVENTION

It is an object of the present invention, therefore, to provide a method for propelling a projectile substance from a gun assembly that reduces the risk of premature firing of the gun assembly.

It is another object of the present invention to provide a method for safely and effectively disarming an explosive device by firing a projectile substance from a gun assembly such that the projectile substance strikes the device. Accordingly, the projectile substance is propelled without exposing the explosive device to a flame.

It is a further object of the present invention to propel a projectile substance from an apparatus by the release of pressurized gas from a chamber within the apparatus. This release of gas dictates an average pressure for propelling the projectile substance. Features of the present invention will increase this average pressure. Other features will increase the pressure available for propelling the projectile substance above the pressure supplied by the source of the pressurized gas.

It is a further object of the present invention to propel a projectile substance from an apparatus by the release of pressure from a chamber within the apparatus. The pressure may be created by alternate methods.

Accordingly, in one embodiment of the present invention, a method is provided for pneumatically propelling a projectile substance. The projectile is inserted into a longitudinal bore of a barrel and a rupture disk is attached to a first end of the barrel. The first end of the barrel is coupled to a first end of a pneumatic reservoir having a chamber therein. The rupture disk, as attached, forms a seal between the longitudinal bore and the chamber. A gas is introduced into the chamber until a sufficient pressure is attained within the chamber to rupture the disk. When the disk ruptures, the gas in the chamber is released into the longitudinal bore with sufficient force to propel the projectile substance out of the barrel. A secondary force is provided in the chamber to increase an average pressure in the barrel as the gas is released into the barrel.

According to one feature of this embodiment, a piston is slidably disposed in the chamber to separate the chamber into a first portion between the piston and the rupture disk and a second portion between the piston and a second end of the pneumatic chamber. The secondary force can be supplied by different methods. For example, a spring or pressurized gas may be provided in the second portion of the chamber to supply the secondary force when the gas is released from the first portion into the barrel. The secondary force adds to the force provided by the release of gas from the first portion, thereby increasing an average pressure in the bore. This should cause a higher exit velocity for the projectile substance.

According to another feature of the present embodiment, the secondary force may act to multiply the pressure in the chamber to increase the pressure available for propelling the projectile substance. The multiplied pressure is greater than that supplied by the source of the gas. This is accomplished by providing a second piston having a greater end surface area than that of the first piston. The two pistons are slidably disposed within the chamber to separate the chamber into a first portion between the first piston and the rupture disk and a second portion between the second piston and a second end of the chamber. The longitudinal distance between the pistons may be fixed, for example, by connecting the two pistons with a common shaft. Pressurized gas is introduced into the first portion, thereby compressing the gas in the second portion. The secondary force can be supplied by different methods. For example, additional gas may be introduced into the second portion. Alternatively, the compressed gas in the second portion may be combusted. Another alternative is to ignite an explosive, e.g. solid propellant, which is provided in the second portion.

According to another embodiment of the present invention, a method is provided for propelling a projectile substance. The projectile is inserted into a longitudinal bore of a barrel and a rupture disk is attached to a first end of the barrel. The first end of the barrel is coupled to a first end of a pneumatic reservoir having a chamber therein. The rupture disk, as attached, forms a seal between the longitudinal bore and the chamber. A liquid is provided in the chamber and heated to increase the pressure in the chamber until a sufficient pressure is attained to rupture the disk. When the disk ruptures, the pressure in the chamber is released into the longitudinal bore with sufficient force to propel the projectile substance out of the barrel.

According to one feature of this embodiment, the pressure in the chamber may be increased by introducing a cryogenic liquid into the chamber. The liquid is heated and expands to increase the pressure in the chamber.

According to an alternate feature of this embodiment, the pressure in the chamber is increased by the creation of steam within the chamber. To create the steam, water may be introduced into the chamber and then heated. Alternately, an electrolyte, e.g., salt water, may be introduced into the chamber. By energizing an electrode, which extends into the electrolyte, the electrolyte may be heated to produce steam.

A technical advantage of the above-described embodiments is that the risk of premature firing of the projectile substance is reduced from the risk associated with known propelling methods. Another technical advantage of the above-described embodiments is that a projectile substance may be propelled toward an explosive device, thereby disarming the device, without exposing the device to a flame. Further objects, features, and advantages of the present invention will be understood from the detailed description of the preferred embodiments of the present invention with reference to the appropriate figures.

BRIEF DESCRIPTION OF THE DRAWINGS

FIG. 2B shows the mounting assembly of FIG. 2A from a direction represented by arrow A.

DETAILED DESCRIPTION OF THE PREFERRED EMBODIMENTS

Figure 1:
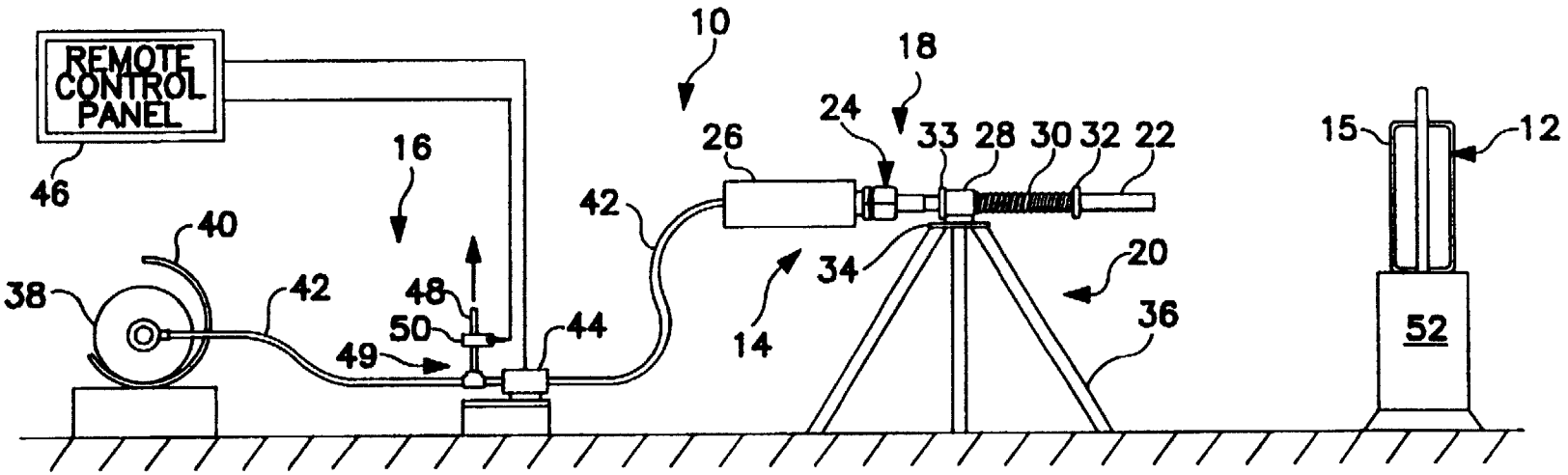
FIG. 1 is a system for disarming an explosive device incorporating the present invention.

FIG. 1 shows a system 10 for disarming an explosive device 12. Disarming system 10 includes a gun assembly 14 for firing a projectile substance at device 12 to pierce enclosure 15 of device 12. A pneumatic charging assembly 16 is provided to communicate pressurized gas with gun assembly 14 to fire the selected projectile substance.

Figure 3:
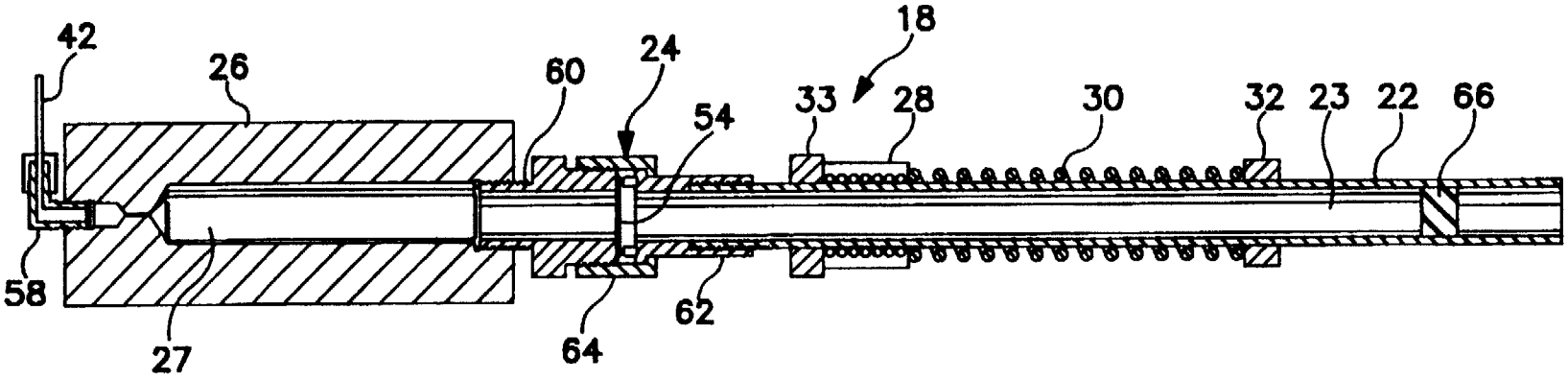
FIG. 3 is a longitudinal sectional view of a pneumatic gun for use with the system of FIG. 1.

As shown in FIG. 3, gun assembly 14 includes a pneumatic gun 18 and a mounting assembly 20. Pneumatic gun 18 includes a barrel 22 having a longitudinal bore 23 for holding and aiming the selected projectile substance prior to firing. A coupling assembly 24 attaches one end of barrel 22 to a pneumatic reservoir 26, such that a chamber 27 within pneumatic reservoir 26 communicates with longitudinal bore 23.

A portion of gun barrel 22 is preferably slidably disposed within a linear bearing 28. Collars 32 and 33 are preferably disposed on the exterior of barrel 22 spaced longitudinally from each other. Linear bearing 28 is positioned to contact collar 33. A spring 30 surrounds the exterior of barrel 22 between linear bearing 28 and collar 32. Bearing 28, spring 30 and barrel collars 32 and 33 cooperate to absorb the recoil caused by the firing of pneumatic gun 18.

Referring again to FIG. 1, mounting assembly 20 supports pneumatic gun 18 in the desired firing position for disarming explosive device 12. Mounting assembly 20 includes a mounting platform 34 supported by legs 36. Legs 36, which are preferably in a tripod arrangement, can rotate in an up/down direction with respect to platform 34 in order to adjust the height of gun 18.

Bearing 28 may be used to couple pneumatic gun 18 to platform 34. Bearing 28 may include a swivel joint (not shown) to allow gun 18 to swivel in an azimuth plane. Alternatively, bearing 28 may include a ball joint (not shown) to allow gun 18 to pivot in elevation as well.

Figure 2B:
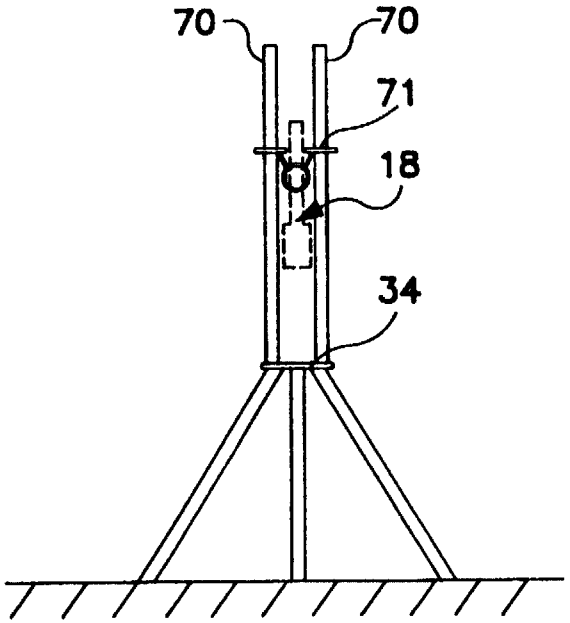
FIGS. 2A–2B show a mounting assembly for use in the system of FIG. 1.
Figure 2A:
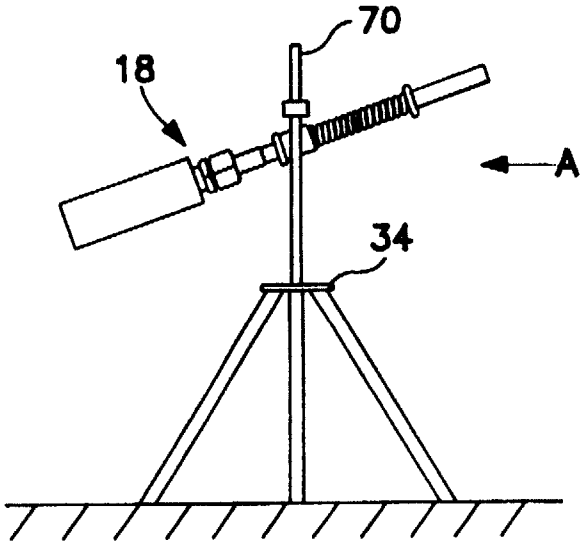

As shown in FIGS. 2A–2B, mounting assembly 20 may be modified to allow adjustment of the orientation of gun 18 with respect to the horizon. According to the modification, a pair of rods 70 is preferably attached to platform 34 or to bearing 28 (if provided). The attachment may be achieved, for example, by forming a threaded hole in an end of each rod 70 and screwing the rods 70 onto bolts (not shown) extending from platform 34 or bearing 28. Preferably, rods 70 extend from assembly 20 perpendicular to the surface of platform 34. A clamping mechanism 71 is attached to rods 70 and spaced from platform 34. Pneumatic gun 18 is preferably attached to clamping mechanism 71, such that gun 18 is positioned between rods 70. Mechanism 71, when gun 18 is mounted on assembly 20, is preferably rotatable to allow gun 18 to be angularly displaced from the surface of platform 34. These optional attachments and joints provide various dimensions of adjustment which facilitate the aiming of gun 18. For convenience, pneumatic gun 18 is shown in phantom in FIG. 2B.

Referring again to FIG. 1, charging assembly 16 includes a canister 38 for holding a gas, typically air, under pressure. Canister 38 may be a Self Contained Breathing Apparatus (SCBA) or other type of container holding a gas under pressure. A shield 40, which partially encloses canister 38, prevents any blast fragments from explosive device 12 from puncturing canister 38. Such puncturing of canister 38 may cause an uncontrolled release of high pressure gas.

A high pressure gas line 42 provides communication between canister 38 and gun 18. A valve 44 regulates the gas flow between canister 38 and gun 18. A vent assembly 49, including a vent line 48 and a vent valve 50, is positioned along line 42 between canister 38 and valve 44. Vent valve 50, when open, vents gas line 42 to relieve the pressure within reservoir 26. An operator can control both valve 44 and vent valve 50 from a remote control panel 46. Remote control panel 46 is typically located a sufficient distance from disarming system 10 to provide safety to the operator from accidental detonation of explosive device 12.

In operation, the appropriate portion of device 12 for the projectile substance to, enter is determined. Typically, X-rays are taken of device 12 and analyzed to determine the appropriate portion containing the electronic triggering circuit (not shown) or other component which will allow disarming of device 12. However, other non-invasive methods may be used a!; well. Typically, the explosive device 12 is then deactivated in its originial position to avoid accidental detonation. When appropriate, however, explosive device 12 may be placed on a support 52. Alternatively, as the situation may require, explosive device 12 may be placed directly upon the ground.

A projectile substance, typically comprising water, particulate material (such as sand), or a gelling agent, is loaded into barrel 22. Barrel 22 is then aimed at the appropriate portion of explosive device 12. Valve 44 is opened, and gas from canister 38 flows into chamber 27. When the pressure inside chamber 27 reaches a predetermined value, rupture disk 54 ruptures and the gas is suddenly released into bore 23. This sudden release of gas propels the projectile substance out of barrel 22 with sufficient momentum to penetrate and deactivate explosive device 12.

Once the projectile is fired, the operator remotely closes valve 44 to stop the flow of gas into chamber 27. Alternatively, an automatic mechanism (not shown) can be installed to automatically shut valve 44 after gun 18 has been fired.

Occasionally, gun 18 malfunctions and does not fire. If such a malfunction occurs, the operator can open vent valve 50 to safely release the pressure within chamber 27 before gun 18 is serviced.

The projectile substance is typically comprised of water in whole or in part. A projectile substance comprising water provides significant advantages over other types of projectiles. Water will prevent any sparking upon penetration of enclosure 15 of device 12. Such sparking, if it were to occur, might detonate the explosive material within device 12. Additionally, the water may facilitate the destruction of any associated electronic circuitry within device 12 by causing a short circuit. Other advantages of using water as a main element of a projectile substance are that it is inexpensive, easy to obtain, and safe to handle.

Although the projectile substance may comprise water alone, it is often advantageous to mix the water with either a particulate material, such as sand, or a gelling agent. Both the particulate material and the gelling agent serve to hold the projectile substance together. Without these additives, the water may tend to "spray" from a barrel 22 and be less effective as, a projectile.

A water-based projectile substance is typically used for explosive devices having a relatively soft enclosure 15. An example of such a device is a "suitcase bomb". A water-based projectile may not be as effective on a device, such as pipe bomb, having a hard enclosure 15. However, a solid projectile, such as a ball bearing, may be used in conjunction with gun assembly 14 to penetrate such a "hard-shelled" device.

FIG. 3 is a more detailed view of pneumatic gun 18. Coupling elbow 58 connects line 42 to pneumatic reservoir 26, thus establishing communication between line 42 and chamber 27. An adapter 60, having an interior bore in communication with chamber 27, is coupled to the other end of pneumatic reservoir 26. Barrel 22 is coupled to one end of a bushing 62. A coupling 64 couples the opposite end of bushing 62 to adapter 60 so that chamber 27 can communicate with longitudinal bore 23. Adapter 60, bushing 62 and coupling 64, therefore, cooperate to form coupling assembly 24.

A rupture disk 54 is disposed between adapter 60 and bushing 62 to form a fluid barrier, i.e. seal, between chamber 27 and longitudinal bore 23 until the pressure within chamber 27 becomes sufficient to burst through disk 54. Typically, disk 54 is made out of brass or bronze shim stock ("shim stock" is a thin piece of metal). The thickness of the shim stock used in pneumatic gun 18 is typically between 0.0060 and 0.0100 inches. The thicker rupture disk 54 is, the higher is the pressure required to rupture it.

Brass and bronze, when used to form disk 54, provide at least two advantages over other metals. First, brass and bronze are non-sparking; neither will generate sparks upon penetration of enclosure 15 of device 12 which might ignite the explosive material therein. Although disk 54 or any fragment thereof is not intended to become a projectile, fragments are sometimes projected from barrel 22. Second, a brass or bronze disk 54 is soft enough to form a good seal between chamber 27 and longitudinal bore 23. That is, using a brass or bronze disk 54 eliminates the need for additional seals.

Figure 4:
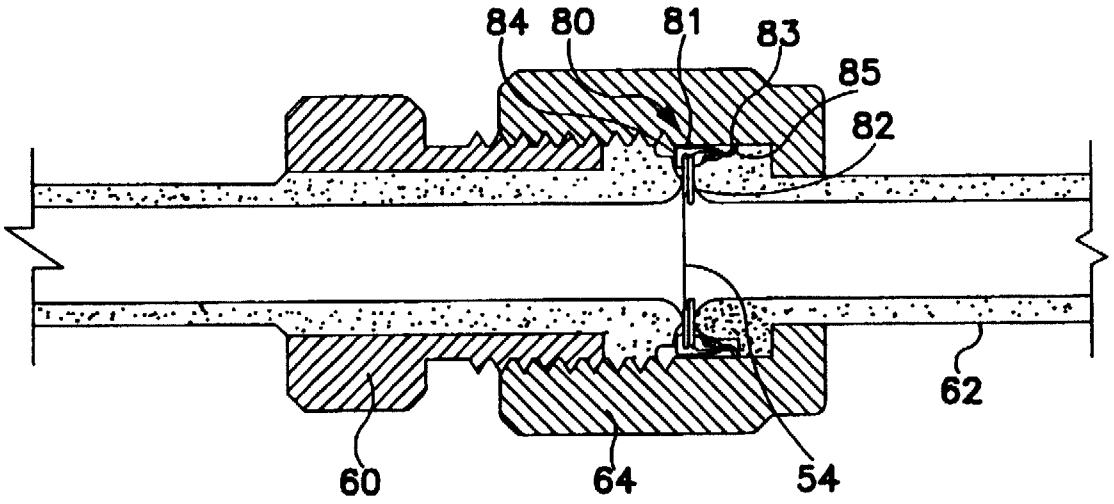
FIG. 4 is a partial view of the pneumatic gun of FIG. 3.

Occasionally, disk 54 ruptures prematurely ruptures due to over-tightening of the connection between adapter 60 and bushing 62, which holds disk 54. Premature rupturing is preferably avoided by tightening the connection according to proper torque or by providing a disk retainer assembly 80, as shown in FIG. 4. Assembly 80 has retainer 81 and gasket 82. Retainer 81 has annular cylindrical portion 83 with a plurality of tabs 85 extending from one end of portion 83. Annular extension 84 extends radially inward from the other end of portion 83. Gasket 82 is disposed within cylindrical portion 83. Disk 54 is positioned between gasket 82 and annular extension 84. Gasket 82 provides a supporting surface for receiving the force from the tightening of adapter 60 and bushing 62. This arrangement preferably reduces the amount of force that disk 54 has to bear when the connection between adapter 60 and bushing 62 is made, thereby reducing the potential for disk 54 to prematurely rupture. Assembly 80 may be a commercially available disk retainer assembly such as that provided in a CAJON VCRO®—type pipe connection.

In operation, the projectile substance is loaded into bore 23 of barrel 22. In one loading procedure, coupling 64 is uncoupled from adapter 60 and slid down the outside of barrel 22 to expose the end of bushing 62. Any rupture disk 54, or part thereof, which is present from the last firing, is removed. A soft plug 66, typically made from plastic, is inserted into the opposite end of barrel 22. The projectile substance is then inserted into longitudinal bore 23 via the end of barrel 22 opposite plug 66. Plug 66 serves to prevent the projectile substance from leaking out of bore 23. A new rupture disk 54 is installed before coupling 64 is reattached to adapter 60.

In a second loading procedure, rupture disk 54 is first installed as described above. The projectile substance is loaded into bore 23 through the end of barrel 22 opposite rupture disk 54. Plug 66 is then inserted in the same opposite end of barrel 22 to prevent the projectile substance from leaking out of bore 23.

Once pneumatic gun 18 is properly loaded, it is mounted and aimed at device 12 as described above in conjunction with FIG. 1. Valve 44 is opened and pressurized gas flows into chamber 27 via line 42 and elbow 58. The pressure within chamber 27 continues to rise until it is sufficient to rupture disk 54. The force of the gas escaping from chamber 27 into barrel 22 propels the projectile substance and the plug out of bore 23. The projectile substance penetrates enclosure 15 of and disarms explosive 12.

Typically, the thickness of disk 54 is chosen so that it ruptures when the pressure within chamber 27 reaches approximately 2200 pounds per square inch (psi). However, rupture disks having rupture pressures of up to approximately 5000 psi can be used with pneumatic gun 18. Moreover, some features of the embodiments of the present invention permit the use of rupture disks that will rupture at pressures of 10,000 psig or greater. The higher the pressure which builds in chamber 27 before disk 54 ruptures, the greater the momentum imparted to the projectile substance.

The explosive force of the discharging gas, in addition to propelling the projectile substance, causes gun 18 to recoil in a direction away from the discharge end of barrel 22. The recoil force causes barrel 22 to slide within linear bearing 28 in the same direction. This sliding motion forces collar 32 to compress spring 30 against the adjacent edge of bearing 28. Thus, spring 30 absorbs the recoil shock. Once the recoil shock is absorbed, spring 30 decompresses and forces collar 32 away from bearing 28. Barrel collar 33 limits the spring 30 decompression by abutting the other end of bearing 28. Thus, spring 30 restores pneumatic gun 18 to its prefiring position with respect to bearing 28.

Figure 5:
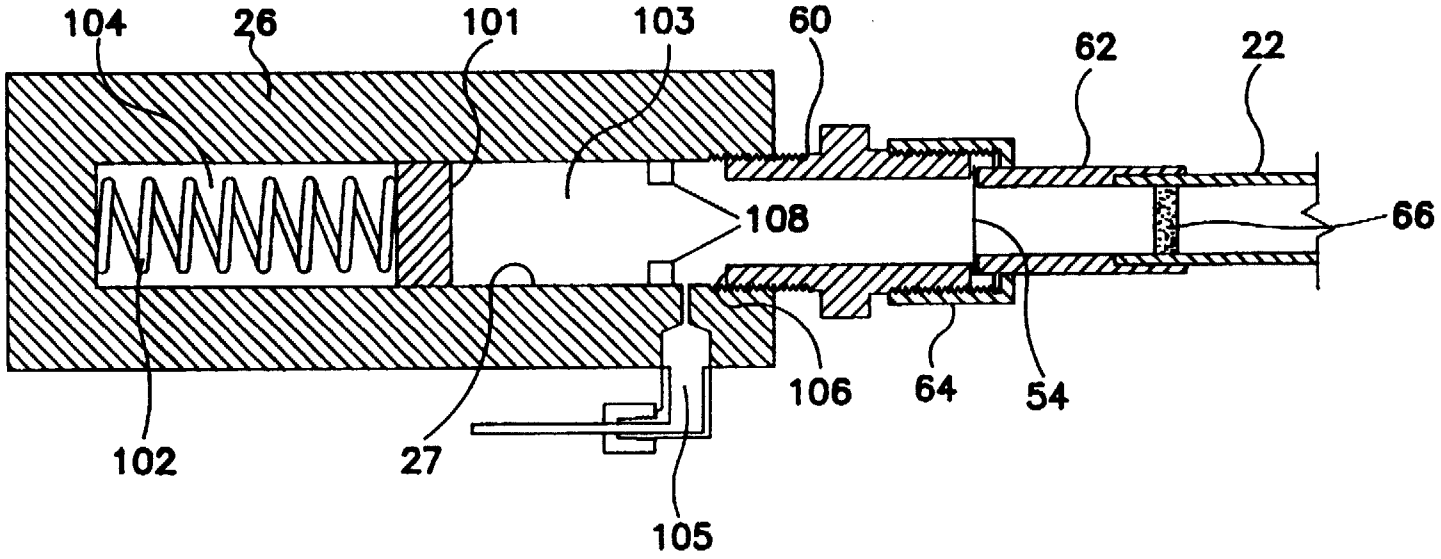
FIG. 5 is the pneumatic gun of FIG. 3 modified in accordance with a first embodiment of the present invention.

According to an embodiment of the present invention, pneumatic gun 18 is modified to provide a secondary force within chamber 27. The secondary force is provided by alternate modifications of gun 18 as shown in FIGS. 5–12. Referring to FIG. 5, in one method of providing the secondary force, a piston 101 is slidably disposed within chamber 27 thereby dividing chamber 27 into a first portion 103 and a second portion 104. A spring 102 is provided within second portion 104. One end of spring 102 engages the surface of chamber 27 while the other end of spring 102 engages piston 101.

In operation, spring 102 and piston 101 cooperate to supply the secondary force. Pressurized gas from a source (not shown) is introduced into first portion 103 through inlet 105. As the pressure in first portion 103 increases, piston 101 is forced away from rupture disk 54, thereby compressing spring 102 as describe above in connection with FIGS. 1–3. The pressure within chamber 27 continues rise until it is sufficient to rupture disk 54. The force of the gas escaping from chamber 27 into barrel 22 propels the projectile substance and the plug out of bore 23. According to this feature, as the pressure is released from first portion 103, spring 102 decompresses and drives piston 101 toward disk 54. This movement of piston 101 tends to compress the gas remaining between piston 101 and the exit end of barrel 22 due to the resistance provided by plug 66, the projectile substance, and friction between the gas and the inner surfaces of barrel 22, bushing 62, coupling 64, disk 54, adopter 60 and first portion 103.

Although the gas, the projectile substance, and plug 66 are allowed to escape from the exit end of barrel 22, the movement of spring 102 and piston 101 results in a higher average pressure for propelling the projectile substance then the average pressure resulting from the discharge of compressed gas from first portion 103 alone. According to an aspect of this feature, spring 102 may be rigidly connected to piston 101, an inner surface of chamber 27, or both. Alternatively, spring 102 and piston 101 may be loosely placed within chamber 27. If this alternative arrangement is used, tabs 108 maybe provided to limit the movement of piston 101 within chamber 27.

Figure 6:
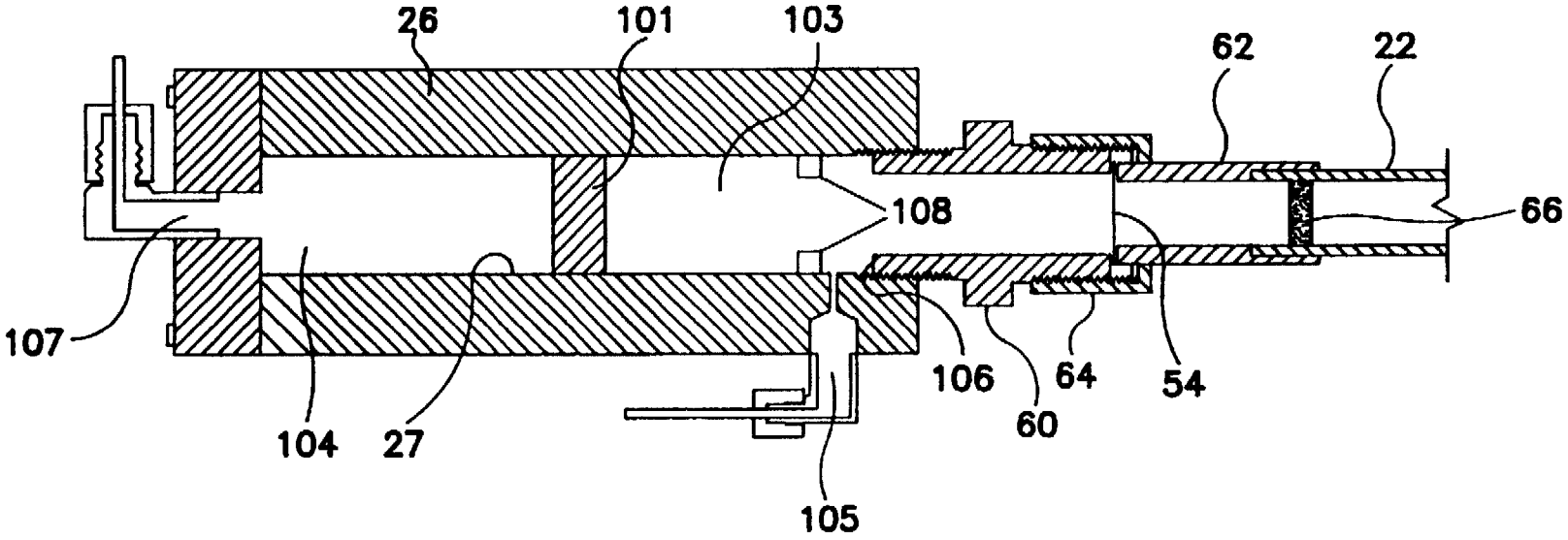
FIG. 6 is the pneumatic gun of FIG. 3 modified in accordance with the first embodiment of the present invention.

Referring to FIG. 6, according to an alternate method of supplying the secondary force, a piston 101 is slidably disposed within chamber 27 as described above. Piston 101 separates chamber 27 into first portion 103 and second portion 104. A first inlet 105 is provided to communicate a pressurized gas source (not shown) with first portion 103. A second inlet 107 is provided to communicate a pressurized gas source (not shown) with second portion 104. The source of the pressurized gas for inlet 105 and inlet 107 maybe the same. Alternately, separate pressurized gas sources may be used.

In operation, pressurized gas is introduced into first portion 103 and second portion 104 through first inlet 105 and second inlet 107, respectively. The pressure in first and second portions 103, 104 is allowed to equilibrate at some level below the rupture pressure of disk 54. Next, second inlet 107 is closed and additional pressurized gas is introduced into first inlet 105. As the pressure in first portion 103 rises, piston 101 is forced away from disk 54, thereby compressing the gas in second portion 104. When a sufficient pressure is reached in first portion 103, disk 54 ruptures and the pressurized gas from first portion 103 escapes into bore 23. Concurrently, the pressurized gas in second portion 104 decompresses, thereby forcing piston 101 towards disk 54. In a manner similar to that described above, this movement of piston 101 causes the average pressure for propelling the projectile substance to be greater than the average pressure provided by the release of pressurized gas from first portion 103 alone. According to an aspect of this feature, in a manner similar to that described for the method in connection with FIG. 5, tabs 108 my be provided for limiting the movement from piston 101 toward disk 54.

Figure 7:
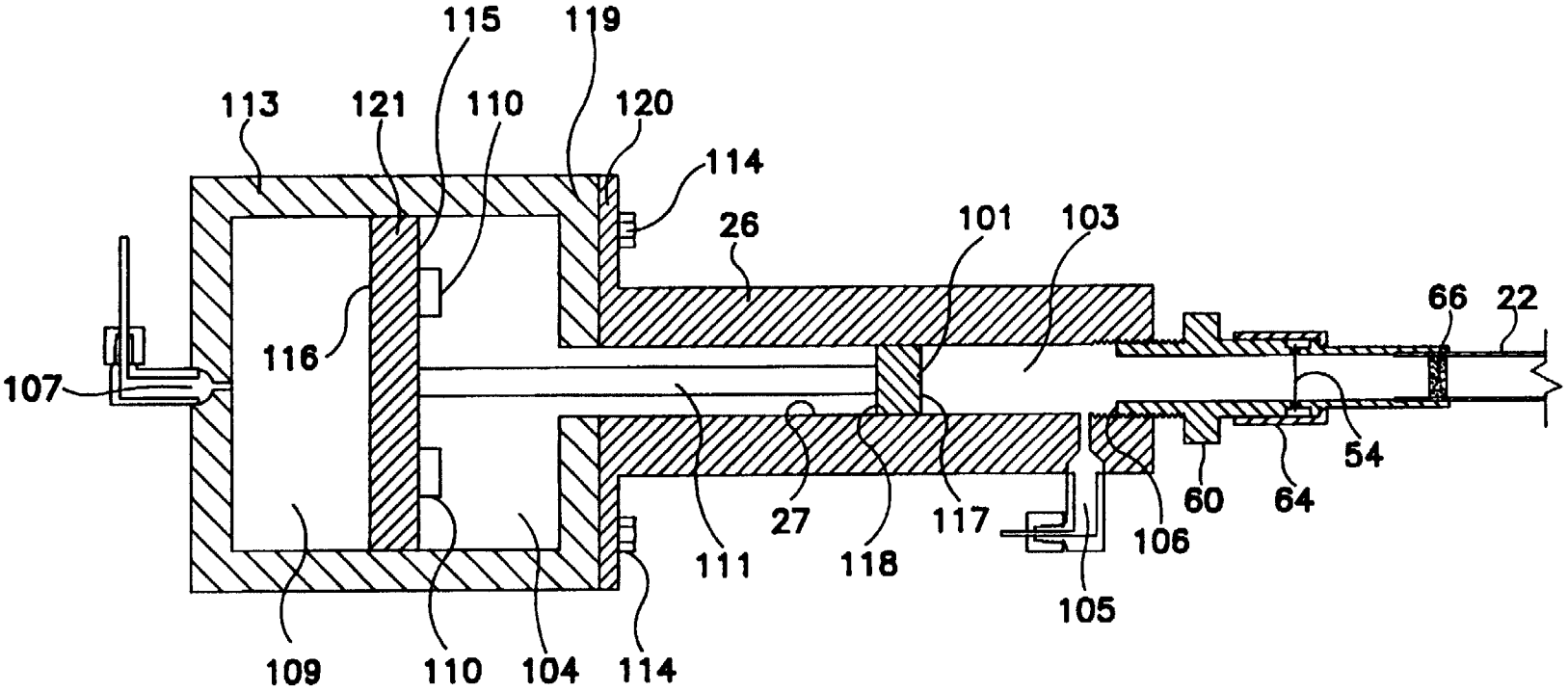
FIG. 7 is the pneumatic gun of FIG. 3 modified in accordance with the first embodiment of the present invention.

According to another feature of this embodiment, the pressure in the portion between piston 101 and rupture disk 54 may be multiplied by providing a pressure multiplier within chamber 27. Referring to FIG. 7, chamber 27 comprises the inner hollow spaces of pneumatic reservoir 26 and housing portion 113. Reservoir 26 preferably has a open end from which annular extension 120 extends radially outward. Housing portion 113 preferably has a open end from which annular extension 119 extends radially inward. Reservoir 26 and housing portion 113 are preferably connected at annular extensions 119, 120 by a plurality of bolts 114. The open ends of reservoir 26 and housing portion 113 preferably communicate the inner spaces of reservoir 26 and housing 113 to create chamber 27.

A piston 101 is slidably disposed in chamber 27 within pneumatic reservoir 26 to create a first portion 103 between piston 101 and rupture disk 54. The pressure of the gas introduced into first portion 103, as describe below, may be multiplied by providing a pressure multiplier within chamber 27. This pressure multiplier comprises a second piston 121 which is slidably disposed in chamber 27 within housing portion 113. Preferably, pistons 121 and 101 are rigidly connected by a rod 111 to provide a constant distance between the pistons. A second portion 109 is defined by an end surface 116 of piston 121 and the inner surface of chamber 27. A third portion 104 is defined by the space between first piston 101 and second piston 121 Preferably, shock absorbers 110 are provided on second piston 121 for creating a buffer between second piston 121 and the inner surface of chamber 27 when piston 121 moves toward rupture disk 54 as described below.

In operation, pressurized gas is introduced into first portion 103 through first inlet 105. As the pressure in first portion 103 rises, the dual piston assembly, i.e., piston 101, rod 111, piston 121, and shock absorbers 110, is forced away from rupture disk 54. Preferably, the dual piston assembly is forced to a point were further movement of the dual piston assembly is limited by the inner surface of chamber 27. Inlet 105 is then closed, thereby isolating first portion 103. Next, pressurized gas is introduced into second portion 109 through second inlet 107, thereby forcing the dual piston assembly toward rupture disk 54 and further compressing the pressurized gas contained within first portion 103.

As shown in FIG. 7, an end surface 116 of second piston 121 has a greater surface area then an end surface 117 of first piston 101. This disparity in the end surface areas of first and second pistons 101, 121 results in the pressure in first portion 103 being greater than the pressure in second portion 109. Therefore, a rupture disk can be used which has a failure pressure greater than the source of the pressurized gas. For example, a disk rated to fail at 10,000 psig could be used with a pressurized gas source rated at 4,000 psig. This example is for illustration purposes only, however, and it will be easily understood that the relationship between the source pressure and the rupture pressure of disk 54 will be determined, at least in part, by the relative surface areas of end surfaces 116 and 117.

Moreover, in a manner similar to that described above, as disk 54 ruptures and the pressurized gas of first portion 103 is released into bore 23 of barrel 22, the pressurized gas; in second portion 109 provides a secondary force to increase the average pressure in bore 23 for propelling the projectile substance.

Figure 8:
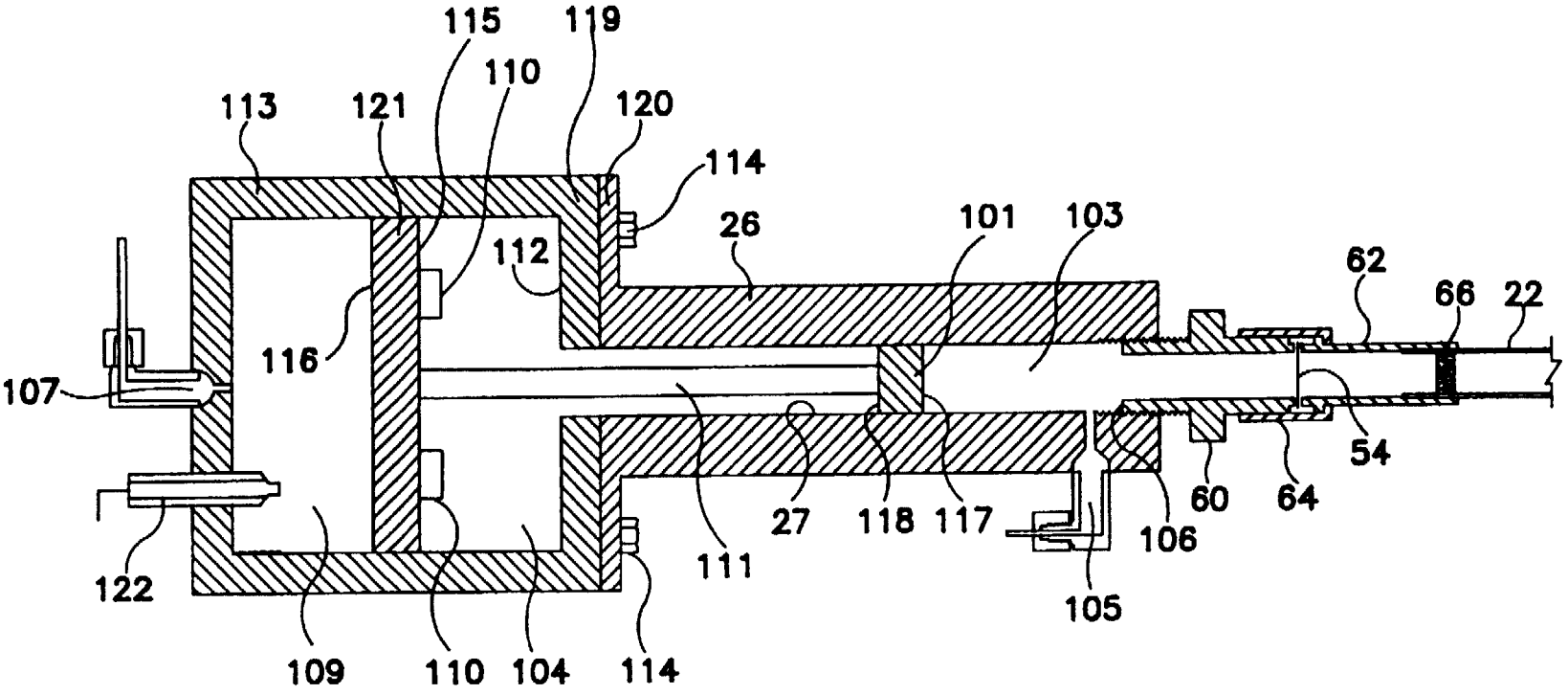
FIG. 8 is the pneumatic gun of FIG. 3 modified in accordance with the first embodiment of the present invention.

A modification of this feature is shown in FIG. 8. According to the modification, pneumatic gun 18 preferably has the same elements as described in the previous method of supplying a secondary force within chamber 27. In this modification, however, second portion 109 acts as a combustion chamber and is fitted with ignitor 122, which is preferably an electric spark ignitor.

In operation, a flammable gas mixture is first introduce into second portion 109 through second inlet 107. Inlet 107 is then closed, thereby isolating second portion 109. Pressurized gas is then introduced into first portion 103 through first inlet 105. Dual piston assembly 101, 111, 121, 113 is thus forced away from rupture disk 54. This movement of the dual piston assembly preferably compresses the flammable gas mixture contained in second portion 109. The flammable gas mixture is preferably compressed to a maximum compression of some pressure below the rupture pressure of disk 54. Ignitor 122 is then activated to ignite the flammable gas mixture. The resulting deflagration drives the dual piston assembly toward rupture disk 54. This motion causes the pressurized gas in first portion 103 to further compress until a sufficient pressure is achieved to rupture disk 54, thereby allowing the pressurized gas in first portion 103 to escape into bore 23 of barrel 22 and propel the projectile substance and plug 66 out of barrel 22. A technical advantage of this feature of the present invention is that the pressure in first portion 103 can be increased significantly above the source pressure. Therefore, a rupture disk 54 can be used that has a higher failure pressure than the pressure supplied by the source. Also, even though combustion of a flammable gas mixture is used as a power source, the target explosive device is still not exposed to a flame since second portion 109 is sealed from the exterior of pneumatic gun 18.

Figure 9:
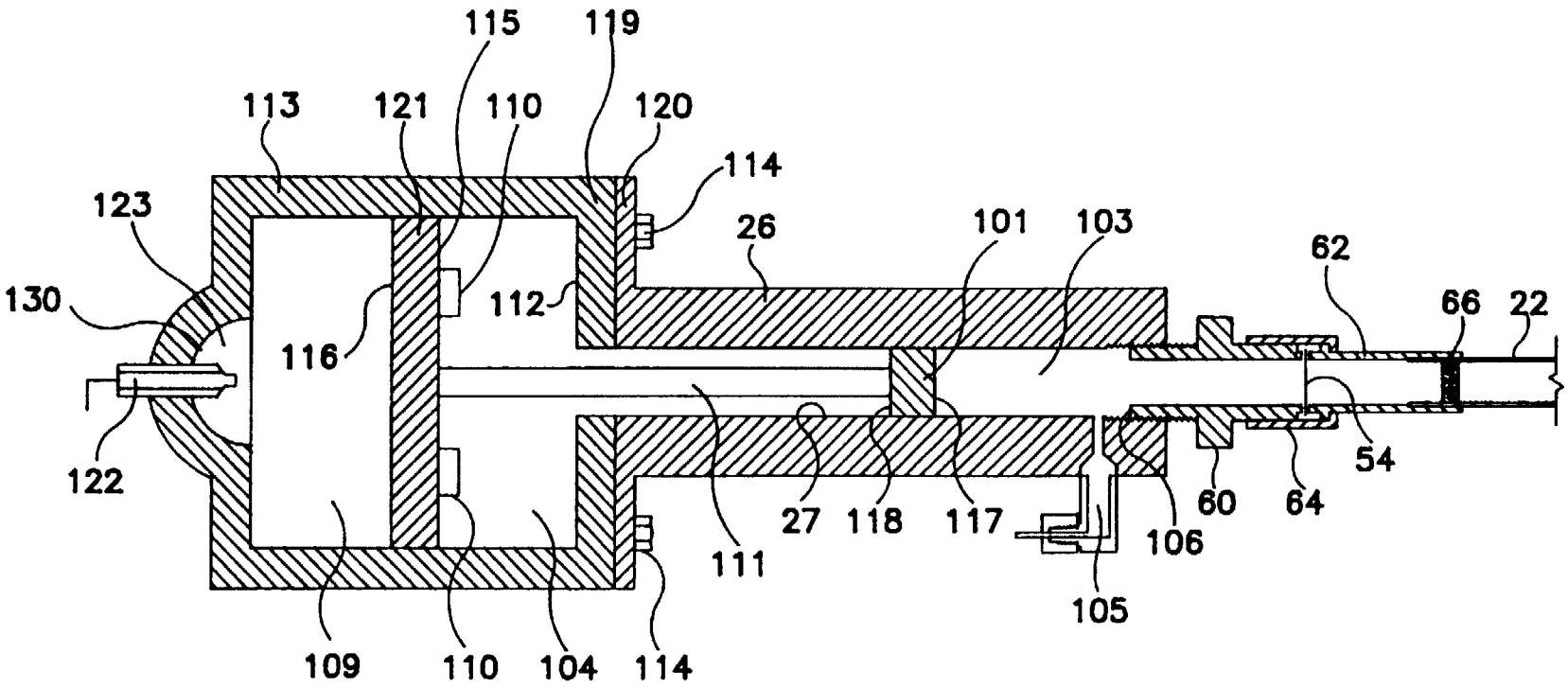
FIG. 9 is the pneumatic gun of FIG. 3 modified in accordance with the first embodiment of the present invention.

FIG. 9 depicts another modification of the pressure multiplication feature. According to this modification, housing 113 has recessed portion 130 spaced apart from second, piston 121 in a direction away from rupture disk 54. Recessed portion 130 is preferably filled with a solid propellant 123. Portion 130 is also fitted with an ignitor 122, which is preferably an electric spark ignitor as previously described.

In operation, pressurized gas is introduced into first portion 103 through first inlet 105, thereby causing the dual piston assembly to move away from rupture disk 54 and toward recessed portion 130. This movement causes ambient air in second portion 109 to compress. Preferably, a maximum compression in second portion 109 is reached, such that a pressure in second portion 109 is somewhere below the failure pressure for rupture disk 54. Solid propellant 123 is ignited by ignitor 122. The resulting explosion drives the dual piston assembly toward rupture disk 54. This motion clauses the pressure in first portion 103 to rapidly rise. As a sufficient pressure is attained in first portion 103, disk 54 ruptures, thereby releasing the pressurized gas from first portion 103 into bore 23 of barrel 22 and propelling the projectile substance and plug 66 out of barrel 22. As described above, the pressure achieved in first portion 103 is greater than the pressure in third portion 109 resulting from the explosion of solid propellant 123. Also the driving force of the exploding solid propellant 123 causes the average pressure for propelling the projectile substance to be greater than an average pressure supplied solely by pressurized gas escaping from first portion 103.

Figure 10:
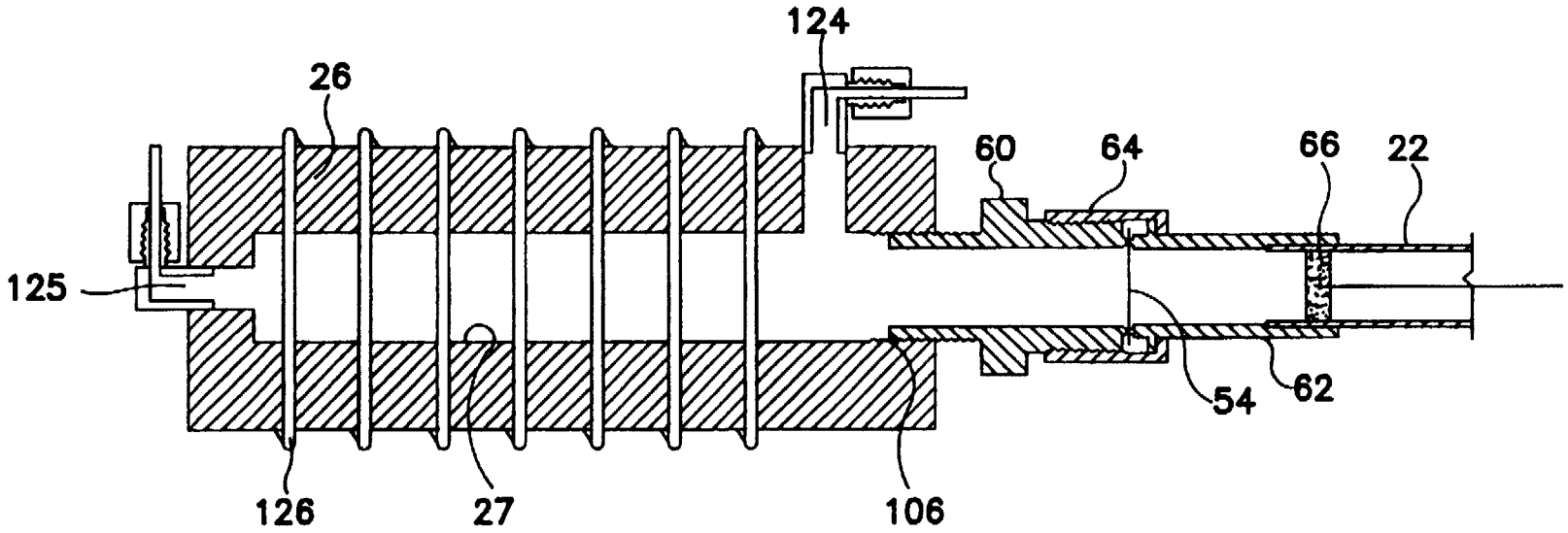
FIG. 10 is a gun for propelling a projectile substance in accordance with a second embodiment of the present invention.
Figure 11:
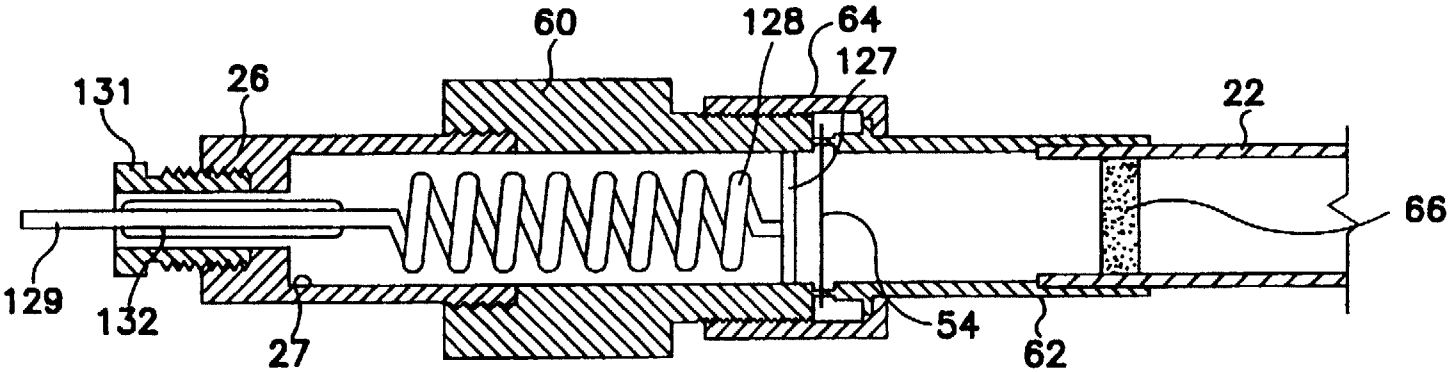
FIG. 11 is the gun of FIG. 8 modified in accordance with the second embodiment of the present invention.
Figure 12:
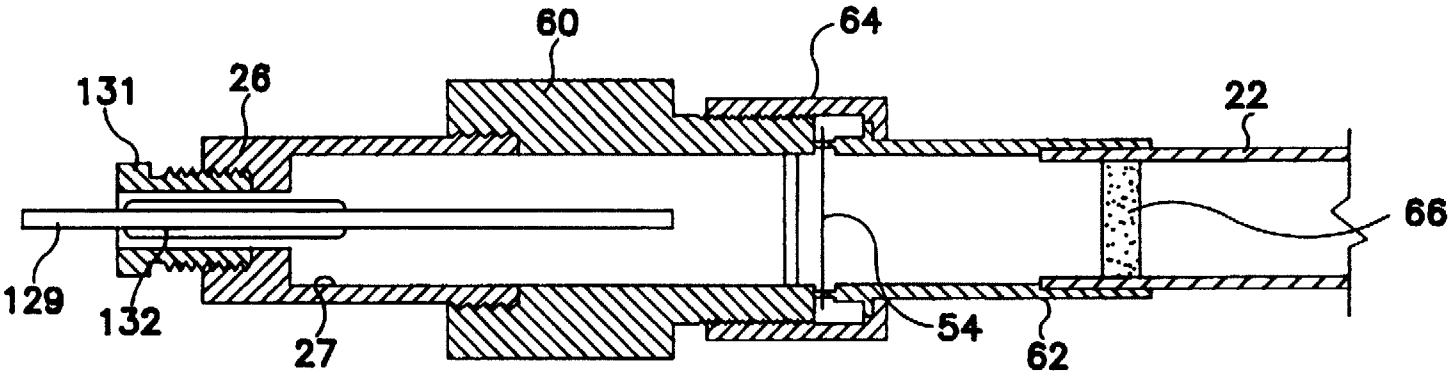
FIG. 12 is the gun of FIG. 8 modified in accordance with the second embodiment of the present invention.

Referring to FIGS. 10–12, another embodiment of the present invention is provided in which the pressure in chamber 27 is increased by the heating of a liquid within chamber 27. One feature according to this embodiment is depicted in FIG. 10. According to this feature, pneumatic gun 18 has pneumatic reservoir 26, chamber 27, adaptor 60, coupling 64, bushing 62, barrel 22, and bore 23, as described previously in connection with FIGS. 5 and 6. A heater coil 126 is disposed about an exterior surface of pneumatic reservoir 26. Reservoir 26 is preferably capable of transferring the heat supplied by heater coil 126 to chamber 27.

In operation, a cryogenic liquid is supplied by a source (not shown) and is introduced into chamber 27 through inlet 125. Chamber 27 is preferably filled until the cryogenic liquid overflows through outlet 124. Inlet and outlet 125, 124 are then closed, thereby sealing chamber 27. Coil 126 is then energized, thereby warming chamber 27 and the cryogenic: liquid contained therein. As the cryogenic liquid warms, the pressure in chamber 27 increases, until a sufficient pressure is reached to rupture disk 54. Preferably, the cryogenic liquid is an inert liquid nitrogen. However, any cryogenic liquid maybe used.

Referring to FIGS. 11 and 12, according to another feature of this embodiment, a liquid may be heated within the chamber to create steam. The creation of steam increases the pressure within the chamber until the pressure is sufficient to rupture disk 54.

According to one aspect of this feature, as shown in FIG. 11, a heating coil 128 is disposed within chamber 27. An insulated electrode 129 extends through a coupling portion 131 which fixedly holds electrode 129. Coupling portion 131 is preferably attached to reservoir 26 such that electrode 129 is insulated from reservoir 26 and such that one end of electrode 129 extends into chamber 27. Electrode 129 is operatively connected to heating coil 128 at its one end. The other end of electrode 129 preferably extends exterior to chamber 27 and is connected to a power source (not shown). Heating coil 128 is preferably grounded to reservoir 26 through grounding rod 127.

In operation, chamber 27 is preferably filled with water. However, other liquids that will produce steam when heated may be used. Electrode 129 is then energized by the power source (not shown) to heat the water and create steam. The creation of steam preferably causes the pressure within chamber 27 to rise until a sufficient pressure is reached to rupture disk 54.

According to another aspect of this feature, as shown in FIG. 12, an insulated electrode 129 is provided as described in connection with FIG. 11. However, a heating coil is not provided within chamber 27. Also, electrode 129 is not grounded to reservoir 26.

In operation, chamber 27 is preferably filled with an electrolyte, e.g., salt water. However, other ionized solutions capable of conducting electricity may be used. Electrode 129 is energized by the power source (not shown) to heat the electrolyte and create steam. The creation of steam preferably causes the pressure within chamber 27 to rise until a sufficient pressure is reached to rupture disk 54.

It will be appreciated that some of the modifications to pneumatic gun 18 may not require the pressurized gas source shown in FIG. 1. Also, some modifications have more thin one inlet for pressurized gas. In these modifications, the pressurized gas source of FIG. 1 can, be modified as necessary to supply gas to the inlets. Alternately, separate sources of pressurized gas may be used. Although the present invention and its advantages have been described in detail, it should be understood that various changes, substitutions, and alternations can be made therein without departing from the spirit and scope of the invention as defined by the appended claims. For example, plug 66 may be formed from other materials such as cork. Also, the projectile substance may comprise liquids other than water. Furthermore, thicker rupture disks may be used which rupture at pressures greater than 5000 psi, or less than 2200 psi. For example, it is envisioned that disks having rupture pressures of 10,000 psig or greater may be used according to the preferred embodiments.

I claim:

1. A method for propelling a projectile substance comprising the steps of:

inserting the projectile substance into a bore of a barrel;

attaching a rupture disk to a first end of the barrel;

coupling the first end of the barrel to a first end of a reservoir having a chamber, wherein the rupture disk forms a seal between the bore and the chamber;

at least partially filling the chamber with a liquid; and heating the liquid to increase the pressure within the chamber until a sufficient pressure is attained within the chamber to rupture the rupture disk and propel the projectile substance out of the barrel.

2. The propelling method of claim 1 wherein the liquid is water.

3. The propelling method of claim 1 wherein the liquid is a cryogenic liquid.

4. The propelling method of claim 3 wherein the cryogenic liquid is inert liquid nitrogen.

5. The propelling method of claim 1 wherein the liquid is an electrolyte.

6. The propelling method of claim 5 wherein the electrolyte is salt water.

7. The propelling method of claim 1 wherein the step of heating the liquid comprises:

disposing a heating coil about an exterior surface of the reservoir; and energizing the heating coil.

8. The propelling method of claim 7 wherein the liquid is a cryogenic liquid.

9. The propelling method of claim 8 wherein the cryogenic liquid is inert liquid nitrogen.

10. The propelling method of claim 1 wherein the step of heating the liquid comprises:

disposing a heating coil within the chamber; and energizing the heating coil.

11. The propelling method of claim 10 wherein the liquid is water.

12. The propelling method of claim 1 wherein the step of heating comprises:

providing an electrode having an end extending into the chamber; and energizing the electrode.

13. The propelling method of claim 12 wherein the liquid is an electrolyte.

14. The propelling method of claim 13 wherein the electrolyte is salt water.

15. An apparatus for propelling a projectile substance comprising:

a barrel having a bore therethrough from which the projectile substance is propelled;

a reservoir having a chamber therein and having a first end connected to a first end of said bore of said barrel;

a rupture disk disposed between said chamber and said bore to prevent communication between said chamber and said bore, until a pressure in said chamber causes said rupture disk to rupture; and a heating coil disposed about an exterior surface of said reservoir, wherein when said heating coil is energized, a cryogenic liquid in said chamber is heated, thereby causing a pressure in said chamber to rupture said rupture disk.

16. An apparatus for propelling a projectile substance comprising:

a barrel having a bore therethrough from which the projectile substance is propelled;

a reservoir having a chamber therein, and having a first end connected to a first end of said bore of said barrel;

a rupture disk disposed between said chamber and said bore to prevent communication between said chamber and said bore, until a pressure in said chamber causes said rupture disk to rupture; and a heating coil disposed within said chamber, wherein when said heating coil is energized, a liquid in said chamber is heated to create steam, thereby causing a pressure in said chamber to rupture said rupture disk.

17. An apparatus for propelling a projectile substance comprising:

a barrel having a bore therethrough from which the projectile substance is propelled;

a reservoir having a chamber therein, and having a first end connected to a first end of said bore of said barrel;

a rupture disk disposed between said chamber and said bore to prevent communication between said chamber and said bore, until a pressure in said chamber causes said rupture disk to rupture; and an electrode extending at least partially within said chamber, wherein when said electrode is energized, an electrolyte in said chamber is heated to create steam, thereby causing a pressure in said chamber to rupture said rupture disk.

* * * * *